US005564241A

United States Patent [19]

Ogorchock et al.

[11] Patent Number: 5,564,241

[45] Date of Patent: Oct. 15, 1996

[54] SOUND-BARRIER PANEL

[76] Inventors: Paul Ogorchock, 4361 High Ridge Rd., Haymarket, Va. 22069; Stephen McCousin, 21167 Crocus Ter., Ashburn, Va. 22011

[21] Appl. No.: 170,723

[22] Filed: Dec. 21, 1993

[51] Int. Cl.[6] ..... F04B 1/82; F04C 1/00; F04H 17/00

[52] U.S. Cl. ..... 52/309.12; 52/612; 52/144; 181/210; 181/294

[58] Field of Search ..... 52/144, 596, 600, 52/602, 605, 309.1, 309.2, 309.7, 309.12, 309.17, 612; 181/210, 294; 106/98

[56] References Cited

U.S. PATENT DOCUMENTS

| | | | |
|---|---|---|---|
| 2,052,517 | 8/1936 | Roos | 52/144 |
| 2,476,433 | 7/1949 | Shinn, Jr. | 52/612 X |
| 3,625,808 | 12/1971 | Martin . | |
| 3,656,576 | 4/1972 | Gubela . | |
| 3,804,196 | 4/1974 | Horn . | |
| 3,845,593 | 11/1974 | Zen | 52/144 |
| 3,943,676 | 3/1976 | Ickes | 52/309.11 X |
| 3,948,009 | 4/1976 | Bernhard . | |
| 4,042,407 | 8/1977 | Natsuume | 106/90 |
| 4,268,317 | 5/1981 | Rayl | 106/89 X |
| 4,325,457 | 4/1982 | Docherty . | |
| 4,513,040 | 4/1985 | Lankard | 52/612 X |
| 4,643,271 | 2/1987 | Coburn . | |
| 4,674,593 | 6/1987 | McCarty . | |
| 4,718,210 | 1/1988 | McCourt et al. | 52/309.12 |
| 4,899,498 | 2/1990 | Grieb . | |
| 5,058,345 | 10/1991 | Martinez | 52/309.12 X |
| 5,136,821 | 8/1992 | Child . | |
| 5,203,629 | 4/1993 | Valle et al. | 366/2 |
| 5,308,397 | 5/1994 | Whatcott | 106/711 |
| 5,339,589 | 8/1994 | Thrower | 52/612 |

*Primary Examiner*—Carl D. Friedman
*Assistant Examiner*—Winnie S. Yip
*Attorney, Agent, or Firm*—Terry M. Gernstein

[57] ABSTRACT

A sound-barrier panel includes an acoustic layer that comprises chipped rubber and cord fiber from tires and a structural concrete layer bonded to the acoustic layer by a combination composite bond that includes both a mechanical portion and a chemical portion. The panel is formed in a special process that can define panels of various sizes, such as twelve feet by twenty-five feet in size. The panel has a high sound absorption capability and a high sound transmission loss, especially at low frequencies, and is extremely weather resistant and durable. The panel is also durable and cost effective and utilizes what otherwise would be potential hazardous waste.

13 Claims, 1 Drawing Sheet

Steps 1-7

Steps 1-7

SOUND-BARRIER PANEL

TECHNICAL FIELD OF THE INVENTION

The present invention relates to the general art of static structures, and to the particular field of sound-absorbing walls.

BACKGROUND OF THE INVENTION

Many urban areas have experienced a significant increase in traffic in many areas in recent years. The traffic generally includes automobiles, but can also include larger vehicles such as trucks and other vehicles which create a great deal of noise such as motorcycles, and the like. If the trucks are large, and the vehicular traffic heavy, anyone living adjacent to a traffic bearing highway will be significantly impacted. In some instances, the noise is so great that normal conversation and sleep is affected, if not totally prohibited.

Recognizing this problem, most highway commissions have noise level standards that include decibel as well as range criteria. If the noise is above a certain level, then many laws and regulations require sound-barrier walls to be erected adjacent to the highway. These sound-barrier walls must, of course, be effective in absorbing sound, but must also be aesthetically pleasing. These walls can be extremely expensive, therefore, an additional requirement is that they be as economical as possible. Economy in such walls is found not only in the manufacture thereof, but in the shipping, storing, erection, use and durability of the wall.

The art has attempted to meet these needs with various sound-barrier walls. While the walls known to the inventors are somewhat successful in some areas, the inventors are not aware of any such sound-barrier wall that meets all the needs of modern highway construction while being economical as that term is used herein.

For example, many presently-known sound-barrier walls do not adequately absorb all noise, especially in the frequencies existing adjacent to a highway. Therefore, such walls may prove to be inadequate after only a short time, especially if, after the wall is erected, the traffic pattern of the highway changes to increase the load of heavy trucks. This may even require replacement of some of the walls. Such replacement is obviously uneconomical.

The inventors have also found that present sound-barrier walls suffer further economic drawbacks due to their low durability, lack of weather resistance and difficulty in storage and erection. For example, some sound-barrier walls presently known to the inventors may fail after only a few freeze-thaw cycles, or do not have good drainage characteristics, or require special, and expensive, shipping procedures, or require a great deal of labor to erect. Any, and all, of these drawbacks result in economic disadvantages to a sound-barrier wall.

Therefore, there is a need for a sound-barrier wall that is efficient in absorbing the noise that will be most prevalent while still being durable, yet is economical, including being weather resistant and environmentally beneficial.

In modern society, even with noise absorption from sound barrier walls, and the like, it is beneficial to have further sound absorption carried out in the buildings and other static structures enclosing people. Therefore, there is a need for a building panel that can be used in a static structure, such as a building, which can absorb sound.

OBJECTS OF THE INVENTION

It is a main object of the present invention to provide a sound-barrier wall that is economical.

It is another object of the present invention to provide a sound barrier wall that has good sound and noise absorption characteristics.

It is another object of the present invention to provide a sound barrier wall that has good sound and noise absorption characteristics in the precise range of sound expected to be incident on the wall.

It is another object of the present invention to provide a sound barrier wall that is environmentally efficient and environmentally beneficial.

It is another object of the present invention to provide a sound barrier wall that is environmentally efficient and environmentally beneficial by utilizing scrap rubber tires.

It is a specific object of the present invention to provide a sound barrier wall that is economical to manufacture, store, ship, erect and yet requires little service over a long lifetime.

It is another specific object of the present invention to provide a sound barrier wall that is durable.

It is another specific object of the present invention to provide a sound barrier wall that is weather resistant.

It is another object of the present invention to provide a sound-absorbing panel that can be used as a wall, or other load-bearing element, in a static structure, such as a building.

SUMMARY OF THE INVENTION

These, and other, objects are achieved by a sound-barrier panel and method of making it in which two layers of material are bonded together by a chemical and mechanical bond to form a unitary panel that is structurally strong, weather resistant and absorbs a high percentage of sound incident thereon. The overall panel is formed in such a manner as to produce a multiplicity of sound absorbing voids, and a multiplicity of tortuous paths whereby sound and fluid flow easily into the panel, with sound being absorbed and fluid passing through the panel. Each panel can be twenty-five feet long or longer and includes material that would otherwise be an environmental liability if not used in this manner.

Specifically, the sound-barrier panel of the present invention includes rubber and fiber from waste tires. The panel has an overall 80–85% sound absorption and good low frequency sound absorption characteristics and a high sound transmission loss, such as an average of 42 dB for a range of frequencies of 100 Hz to 4000 Hz. Because fluid passes easily through the panel, water is easily shed, thereby giving the panel good durability with respect to sound-barrier wall panels presently known. For example, the panel of the present invention has withstood three hundred freeze-thaw cycles before a first failure. After the three hundred cycles, the panel revealed a 0.5% failure rate as opposed to a reported 7% failure rate at ten cycles of some known panels, while other known panels actually failed after two hundred fifty cycles. The panel of the present invention is therefore extremely durable as compared to presently known panels. By using rubber and fiber from waste tires, some of the two hundred fifty million old tires generated yearly that are now plaguing the land fills and other waste disposal facilities in the U.S. can be used. The problem of waste tires has become so great that many landfills actually refuse waste tires. Using the present invention, some waste tires will now have a use thereby alleviating some of the just-mentioned problems.

The process of forming a sound-barrier wall using the panel of the present invention includes forming individual panels that are twenty-five feet long or longer. Such panels reduce the handling and stacking problems associated with prior panels. Such long panels also reduce the amount of steel posts and foundations required for an overall wall thereby reducing costs of both materials and labor associated with the overall wall.

The panel uses tire rubber and fiber to help achieve its sound absorption fluid shedding properties. As a result it consumes this rubber and fiber from tires that would otherwise lay in a scrap yard or be destroyed in an environmentally unsafe way. The panel also does not use wood or synthetic foam thereby further increasing its environmental attractiveness in comparison with other panels known to the inventors.

The panel of the present invention also eliminates effervescence which may be a problem with prior art panels, thereby making the present panel easier and less costly to maintain than prior panels.

Still further, the panel of the present invention, while having the above-discussed properties, is quite strong and stable, thereby making it usable as a structural element in a static structure, such as a building.

BRIEF DESCRIPTION OF THE DRAWING FIGURES

DETAILED DESCRIPTION OF THE PREFERRED EMBODIMENT OF THE INVENTION

Figure 1:
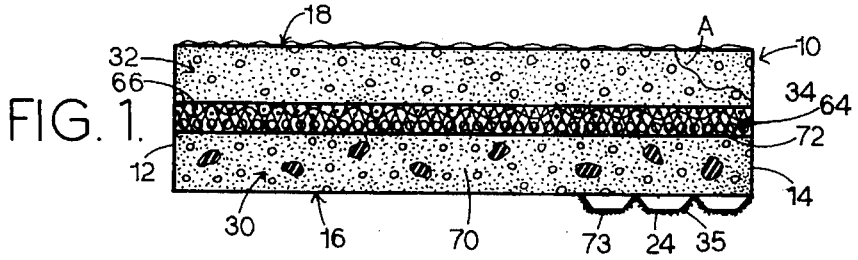
FIG. 1 is an end elevational view of a sound-barrier panel embodying the present invention.
Figure 2:
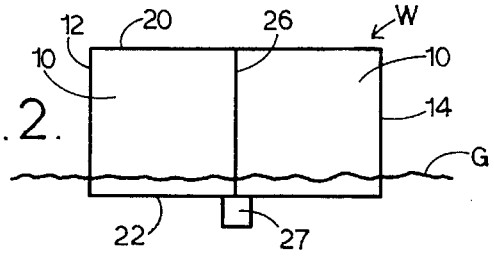
FIG. 2 is a front elevational view of a wall formed of two sound-barrier panels of the present invention.

Shown in FIG. 1 is a sound-barrier panel 10 of the present invention. The panel 10 is connected to other panels to form a wall W anchored in ground G, as indicated in FIG. 2. The overall wall is of any suitable length and can be adjusted to the particular terrain as necessary. Each panel 10 has a length measured between sides 12 and 14 that can be twenty to twenty-five feet or longer, and includes two surfaces, a sound-facing surface 16 and a second surface 18. The panel has a height measured between top end 20 and bottom end 22, and surface 16 has a multiplicity of ribs 24 defined therein to extend along the height dimension of the panel from the top end 20 to the bottom end 22. These ribs aid in the sound absorbing features of the panel because they create a greater surface area with which to absorb the sound as well as a design that helps to capture sound waves by creating more angles of deflection.

As shown in FIG. 2, individual panels are connected at adjacent sides by suitable joint elements 26. The joint elements can be steel joints or other suitable means that are appropriately anchored by an anchor such as anchor 27. The joint elements and anchors do not form part of the present invention and can be commercially available elements. Therefore, the joint elements 26 and anchors 27 will not be further discussed.

Referring back to FIG. 1, the panel 10 includes an acoustic layer 30 and a structural layer 32 bonded together by a composite combination bond 34. The combination bond includes both mechanical bonding and chemical bonding whereby a secure, durable bond is formed in an efficient manner. The acoustic portion of the panel is open graded and has a popcorn-like appearance on surface 35 which captures not only sound waves of higher frequency, but also sound waves of lower frequency. The panel thus is frequency specific to the frequencies most often encountered adjacent to a highway, and therefore is more efficient than presently existing sound-barrier wall panels. The panel is also free draining whereby it weather-resisting features are further enhanced. Only inert elements are included in the panel, therefore, the panel is not susceptible to rotting, vermin, swelling or other such factors that may tend to degrade the panel.

Figure 4:
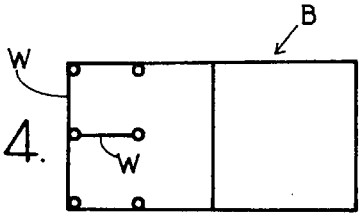
FIG. 4 is a schematic showing the use of the panel of the present invention as a structural element in a static structure, such as a building.

FIG. 4 illustrates a layout of a building B which includes a plurality of walls W. The walls are formed of the panels as discussed above, and these panels are supported by joint elements and the like as discussed above. Alternatively, the walls can be supported in the manner of building walls.

By way of example, the following ingredients are used to make one cubic yard of panel product mixture:

EXAMPLE 600 lbs of cementitious material (cement, new CEM or fly ash).

645 lbs of lightweight coarse aggregate.

90 lbs of chipped rubber from tires (1" top size).

80 lbs of cord fiber from tires (¼" to 1" maximum).

One bag of vermiculite lightweight fine aggregate (this is four cubic feet of vermiculite).

Approximately twenty-five gallons of water.

Twenty ounces of water reducing admixture.

Ten ounces of a commercially available air entraining admixture (a chemical introduced with the water).

The above amounts can be varied, if desired, whereby an alternative example will include:

400–700 lbs of cementitious material (cement, new CEM or fly ash).

500–700 lbs of lightweight coarse aggregate.

50–120 lbs of chipped rubber from tires (1" top size).

30–90 lbs of cord fiber from tires (¼" to 1" maximum).

5½ lb bag of vermiculite lightweight fine aggregate (this is four cubic feet of vermiculite).

Approximately twenty to thirty gallons of water.

Twenty ounces of water reducing admixture.

Ten ounces of a commercially available air entraining admixture (a chemical introduced with the water).

Figure 3:
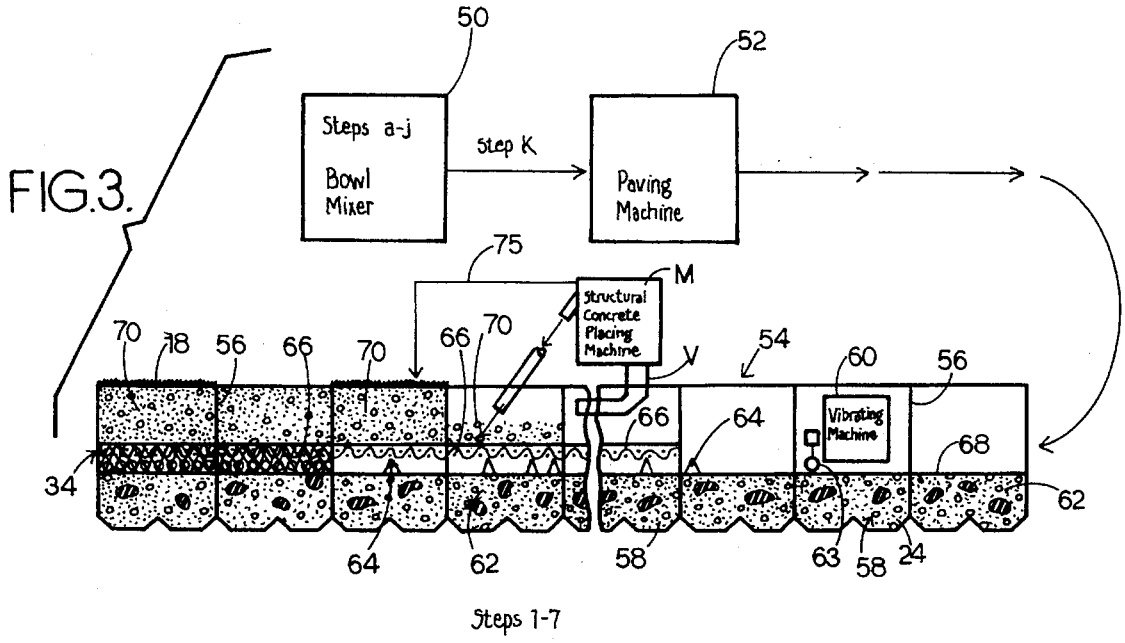
FIG. 3 illustrates the steps in the process of forming the sound-barrier panel of the present invention.

The process of forming the panel 10 is indicated in FIG. 3.

MIXING PROCESS a. The ingredients noted above in the Example are placed in a bowl mixer 50 that is continuously turning as the items are being introduced thereinto, and the items are introduced as follows.

b. Take 90% of the water and all of the admixture, and place them in mixer 50.

c. Add the vermiculite lightweight fine aggregate.

d. Mix these together for two minutes, then, introduce the cementitious material.

e. Mix for two minutes.

f. After this second two minute period has elapsed, add one-half of the lightweight coarse aggregate and continue the mixing.

g. Add all of the tire rubber and tire fibers.

h. Add the rest of the lightweight aggregate.

i. Add the last 10% of the water.

j. Mix this combination of ingredients for about 5–7 more minutes.

k. Discharge this mixture from bowl mixer 50 into a specially designed paving machine 52.

This mixing stage is followed by a forming stage, also illustrated in FIG. 3.

FORMING PROCESS

1. Evenly spread, by way of the paving machine 52, the mixture into a continuous form 54 (or pouring bed). The preferred form is nine feet wide and more than five hundred feet long. A second form can also be used, which, immediately follows the first form. The second form is two hundred fifty feet long. It is noted that as long as the form is more than twenty-five feet long, the length of the form is not critical. Every twenty-five feet in the form, there is a bulkhead 56 so the resulting panels are in twenty-five foot lengths. The bottom of the pouring includes deep ribs 58 so that the side of the panel that, when erected, will face the highway, has ribs 24. Preferably, the ribs are 1½" deep from the facial surface into the depth of the panel and are 4½" wide at the bottom from rib-to-rib.

2. Using a spreading and vibrating machine 60, the poured/spread material, here referred to as acoustic concrete 62, is compacted. Preferably, machine 60 includes a hydraulic cylinder 63 which has a 12" diameter roller drum with a 4" hydraulic cylinder exerting a pressure in the range of between 10 psi and 70 psi.

3. Prior to its setting, lay 2" chairs 64 onto the acoustic concrete 62 to hold up a 4" square wire mesh 66 which is reinforced steel. This wire mesh would actually, because of the legs, end up sitting somewhat above the surface 68 of the acoustic layer. The chairs seat in the acoustic layer while that layer is still soft, and a retarder can be used to ensure that the acoustic layer will remain soft for sufficient time periods.

4. Pour a low slump 5000 psi structural concrete 70 from a structural concrete placing machine M on top of the of the acoustic concrete, so that the result is one composite material which is mechanically and chemically bonded at combination bond 34 that includes the chemical bond formed between the structural concrete and the acoustic layer and the mechanical bond that includes wire mesh 66 and legs 64. It is noted that the bond is not fully homogenized and the structural concrete layer does not completely mix through the acoustic layer. This structural concrete layer is usually laid shortly after the acoustic concrete has been poured, and is vibrated as it is poured on top of the acoustic layer. Machine M includes a vibrator mechanism indicated generally at V, which consolidates the structural concrete and vibrates the grout to settle ingredients through the mesh into the acoustic layer finish. The vibration drives grout of the concrete into the acoustic layer. The vibration step is thus carried out while the acoustic layer is still slightly pliable so both layers set together. The bonding between the acoustic layer and the structural layer is thus chemical as well as mechanical.

5. After the structural concrete sets for about two hours; the bulkheads are removed to form the nine foot by twenty-five foot panels.

6. The resulting product is removed from the pouring bed after it has had about eighteen hours to cure and, using a special lifting apparatus (not shown) it is stored vertically in a covered area to complete the curing process and gain strength.

7. During the pouring step, fuzzy rake finish 18 can be applied to the non-highway side of the panel using mechanism 75. The preferred form of the rake extends completely across the width of the panel. The fuzzy rake finish is applied to the structural side of the panel. The panel is cured over a five to seven day period, by which time the product has reached its design shipping strength of 5000 psi. The 9'×25' panels are then loaded on to specially designed carrier trucks for purposes of being transported to the job site.

8. The panels are hauled right to the job site and erected.

As compared to prior panels, the panels according to the present invention can be erected in a short time with minimal labor. Using the panels of the present invention, a typical erection crew can erect 6,000 s.f. per day of sound barrier. Since the panels are large, fewer steel I-beams are required between the panels, therefore reducing the number of concrete foundations necessary to hold the erected wall.

Because the fine aggregate used in other sound-barrier walls has been replaced by the light-weight stone, the perlite, etc as above discussed, the surface, and indeed, the entire top layer, has an open-graded, "popcorn-like/hollow" appearance. The preferred form of the panel includes a void structure having a significant percentage of the cavities having a diameter larger than ⅛" and one form, larger than ¾". Furthermore, the preferred form of the panel has a density of approximately 75 lb/ft$^3$. Such an irregular surface forms a large, broken and irregular surface area that efficiently captures and dissipates sound incident thereon. The sound is actually reflected within the cavities during such dissipation process. The acoustic layer thus has a multiplicity of sound-absorbing cavities 73 located therein, especially on the surface thereof, as indicated in FIG. 1. The cavities in the acoustic layer can be interconnected by passages P to define a water passage. Also, omission of sand from the acoustic layer eliminates effervescence. Still further, the large cavities of the panel provide an efficient water drainage system in which as much as five gallons of water can be totally drained in less than twenty seconds. The drainage capacity of the panel contributes to the reliability of the panel. A passage is indicated in FIG. 1 as passage A and is formed by the cavities being interconnected along a tortuous path. The panel also has good thermal insulating properties due to the elements used therein, and due to the large void volume of the acoustic portion.

It is understood that while certain forms of the present invention have been illustrated and described herein, it is not to be limited to the specific forms or arrangements of parts or patterns described and shown.

I claim:

1. A composite sound-barrier wall panel comprising:

A) an acoustic layer;

B) a structural concrete layer which includes grout;

C) a combination bond coupling the acoustic layer to the structural concrete layer and including (1) a mechanical portion that includes a plurality of cone-shaped chairs with each chair including
(i) a base embedded in said concrete layer,
(ii) an apex spaced from said base and spaced from said concrete layer, and
(iii) a sloped surface connecting said base to said apex, and
(2) a reinforced steel wire mesh mounted on the sloped surfaces of each of said chairs and being spaced from said concrete layer; and
(3) said acoustic layer and said concrete layer being intermixed, with grout from said concrete layer being in both said acoustic layer and said mesh.

2. The composite sound-barrier wall panel defined in claim 1 wherein said acoustic layer includes cementitious material, lightweight coarse aggregate, chipped rubber, cord rubber, vermiculite, water, water reducing end mixture, and air entraining admixture.

3. The composite sound barrier-defining wall defined in claim 2 wherein said acoustic layer is open graded and includes a multiplicity of sound-absorbing cavities.

4. The composite sound-barrier wall panel defined in claim 1 wherein said acoustic layer includes: 600 lbs of cementitious material, 645 lbs of lightweight coarse aggregate, 90 lbs of chipped rubber from tires, 80 lbs of cord fiber from tires, one bag of vermiculite lightweight fine aggregate, approximately twenty-five gallons of water, twenty ounces of water reducing mixture, and ten ounces of air entraining admixture.

5. The composite sound-barrier wall panel defined in claim 4 wherein said combination bond includes four inch legs on said acoustic layer and four inch square wire mesh on said legs.

6. The composite sound-barrier wall panel defined in claim 1 wherein said acoustic layer has a significant percentage of cavities having a diameter larger than ¾".

7. The composite sound-barrier wall panel defined in claim 6 wherein said cavities are interconnected to define water passages.

8. The composite sound-barrier wall panel defined in claim 7 wherein said acoustic layer has a density of approximately 75 lb/ft$^3$.

9. The composite sound-barrier wall panel defined in claim 8 wherein said water passages are large enough to pass at least five gallons of water through said acoustic layer in under twenty seconds.

10. The composite sound-barrier wall defined in claim 6 wherein said concrete layer has a plurality of structural layer cavities.

11. The composite sound-barrier wall defined in claim 10 wherein said structural layer cavities are interconnected to define structural layer water passages.

12. A wall for use in a static structure comprising:

A) an acoustic layer;

B) a structural concrete layer which includes grout;

C) a combination bond coupling the acoustic layer to the structural concrete layer and including
(1) a mechanical portion that includes a plurality of cone-shaped chairs with each chair including
(i) a base embedded in said concrete layer,
(ii) an apex spaced from said base and spaced from said concrete layer, and
(iii) a sloped surface connecting said base to said apex, and
(2) a reinforced steel wire mesh mounted on the sloped surfaces of each of said chairs and being spaced from said concrete layer; and
(3) said acoustic layer and said concrete layer being intermixed, with grout from said concrete layer being in both said acoustic layer and said mesh.

13. A composite sound-barrier wall panel comprising:

A) an acoustic layer that includes 600 lbs of cementitious material, 645 lbs of lightweight coarse aggregate, 90 lbs of chipped rubber from tires, 80 lbs of cord fiber from tires, one bag of vermiculite lightweight fine aggregate, approximately twenty-five gallons of water, twenty ounces of water reducing mixture, and ten ounces of air entraining admixture;

B) a structural concrete layer that includes a low slump 5000 psi structural concrete, and grout; and C) a combination bond coupling said acoustic layer to said structural concrete layer and which includes
(1) a mechanical portion that includes a plurality of cone-shaped chairs with each chair including
(i) a four inch base embedded in said concrete layer,
(ii) an apex spaced from said base and spaced from said concrete layer, and
(iii) a sloped surface connecting said base to said apex, and
(2) a reinforced four inch square steel square wire mesh mounted on the sloped surfaces of each of said chairs and being spaced from said concrete layer; and
(3) said acoustic layer and said concrete layer being intermixed, with grout from said concrete layer being in both said acoustic layer and said mesh.

* * * * *

UNITED STATES PATENT AND TRADEMARK OFFICE

CERTIFICATE OF CORRECTION

PATENT NO. : 5,564,241

DATED : Oct. 15, 1996

INVENTOR(S) : Paul Ogorchock, et al

It is certified that error appears in the above-indentified patent and that said Letters Patent is hereby corrected as shown below:

Title page, item [76] Inventors: change "Stephen McCousin" to --Stephen McCowin--.

Signed and Sealed this

Twenty-eighth Day of January, 1997

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,564,241
DATED : October 15, 1996
INVENTOR(S) : Ogorchock, Paul and McCowin, Steve It is certified that error appears in the above-identified patent and that said Letters Patent is hereby corrected as shown below:

The above-identified patent incorrectly identifies "Stephen McCousin" as an inventor. The correct name of the inventor is -- Steve McCowin. --

Signed and Sealed this

Fourth Day of February, 2003

JAMES E. ROGAN
*Director of the United States Patent and Trademark Office*